United States Patent [19]

Martin

[11] Patent Number: 4,604,890

[45] Date of Patent: Aug. 12, 1986

[54] COMPRESSION TOOL

[75] Inventor: William C. Martin, Fairview, Pa.

[73] Assignee: Teledyne Penn-Union, Edinboro, Pa.

[21] Appl. No.: 715,599

[22] Filed: Mar. 25, 1985

Related U.S. Application Data

[63] Continuation-in-part of Ser. No. 578,999, Feb. 14, 1984, abandoned, which is a continuation of Ser. No. 347,014, Feb. 8, 1982, abandoned.

[51] Int. Cl.[4] ..... B21J 9/18

[52] U.S. Cl. ..... 72/453.16; 72/410; 72/416; 72/30

[58] Field of Search ..... 72/453.16, 453.15, 453.01, 72/410, 30, 416, 412, 409, 32, 455, 385

[56] References Cited

U.S. PATENT DOCUMENTS

| | | | |
|---|---|---|---|
| 1,327,892 | 1/1920 | Viertels | 72/410 |
| 1,620,260 | 3/1927 | Kellogg | 72/385 |
| 2,516,771 | 7/1950 | Herscher et al. | 72/32 |
| 2,696,850 | 12/1954 | Peterson | 72/453.16 |
| 3,030,838 | 4/1962 | Klingler | 72/453.16 |
| 3,154,978 | 11/1964 | Baker | 78/15 |
| 3,175,281 | 3/1965 | Elfsten | 72/410 |
| 3,326,029 | 6/1967 | Porter | 72/410 |
| 3,334,511 | 8/1967 | Hawkins | 72/455 |
| 3,396,571 | 8/1968 | Porter | 72/410 |
| 3,553,999 | 1/1971 | Rommel | 72/410 |
| 3,732,718 | 5/1973 | Barberio | 72/410 |
| 3,769,704 | 11/1973 | Abarotin | 72/416 |
| 3,791,189 | 2/1974 | Lawson | 72/410 |
| 3,803,897 | 4/1974 | Ridenour et al. | 72/412 |
| 4,132,107 | 1/1979 | Suganuma et al. | 72/453.16 |
| 4,283,933 | 8/1981 | Wiener | 72/409 |
| 4,337,635 | 7/1982 | Martin et al. | 72/453.16 |

FOREIGN PATENT DOCUMENTS

| | | | |
|---|---|---|---|
| 33463 | 9/1912 | Sweden | 72/416 |

OTHER PUBLICATIONS

Burndy, "Y35/Y35-2 Hydraulic Hypress®" instruction booklet—cover page and 3 pages text and drawings.

Ilsco "Compression Tools" booklet—cover page and 3 pages text.

Burndy, "New Y1000 Dieless Hypress®" booklet—cover page and one page text.

Anderson, "Compression Tools and Accessories"—one sheet.

*Primary Examiner*—Lowell A. Larson

*Assistant Examiner*—David B. Jones

*Attorney, Agent, or Firm*—Trexler, Bushnell & Wolters, Ltd.

[57] ABSTRACT

A compression tool comprises a tool head and a pair of dies mounted in the tool head for compressingly, surroundingly engaging a generally tubular workpiece. The dies define a minimum opening and a maximum opening therebetween for accommodating workpieces over a corresponding range of sizes. A fluid operated drive urges the dies inwardly to compress the workpiece and a fluid pressure control is provided for controllably varying the maximum pressure of the fluid supplied to the fluid operated drive in accordance with the size of a workpiece to be compressed.

16 Claims, 8 Drawing Figures

COMPRESSION TOOL

This application is a continuation-in-part of application Ser. No. 578,999, filed Feb. 14, 1984, abandoned, which is a continuation of application Ser. No. 347,014, filed Feb. 8, 1982, abandoned.

BACKGROUND OF THE INVENTION

This invention is directed generally to the field of compression tools and more particularly to a compression tool for compressing or crimping generally tubular workpieces such as connectors or terminals utilized for establishing electrical wiring connections.

A number of compression tools have heretofore been proposed for compressing or crimping the generally tubular terminal or connector members of the type utilized in electrical wiring installations. Briefly, these tubular connectors receive a wire or bundles of wire and must be crimped or compressed in order to securely form both a mechanical and electrical union between the connector or terminal and the wire.

The wire sizes and corresponding connector or terminal sizes vary over a considerable range for achieving different wire gauge connections. For example, the outer diameters to be compressed or crimped may range from as small as ¼" to as large as 2".

Generally speaking, the crimping or compressing tools heretofore proposed for accommodating this range of sizes of connectors or terminals have been of two basic types: (1) a tool having a tool head provided with an interchangeable set of removable diesets, one dieset for each connector size or for sizes within given limited ranges; and (2) a tool having a tool head which carries a single, permanent crimping or compression member which is compressable to different degrees or extents in order to accommodate a given range of sizes.

The former type of tool can be rather difficult and timeconsuming to use, as the removable, interchangeable diesets must be frequently changed in the field, whenever different sized wires and the corresponding connectors or terminals are to be installed. The latter type of tool is generally referred to as a "dieless" compression tool. The term "dieless" refers to the single, permanent die or compressing structure which is utilized, rather than the multiple, interchangeable, removable diesets provided with the former type of tool. Tools of this latter type have heretofore proven relatively heavy and complex, and have been relatively difficult to operate. Moreover, many of these latter tools are prone to frequent malfunction due to the complexities of their design.

Additionally, the tools of the second type have generally provided an indentor-type of crimp, which is a crimp or compression centered about a single indentation, made by the tool, in the terminal or connector. However, a polygonal configuration of compression or crimping is generally regarded as superior in achieving both electrical and mechanical union of such a connector or terminal with electrical wires.

OBJECTS AND SUMMARY OF THE INVENTION

Accordingly, it is an object of this invention to provide a novel and improved compression tool.

A more specific object is to provide a compression tool of the foregoing type which is capable of accommodating a relatively broad range of connector or terminal sizes.

A related object is to provide a compression tool of the foregoing type which provides a polygonal compression configuration to the connector or terminal compressed.

A further object is to provide a compression tool of the foregoing type which is relatively simple in design and easy to use and yet is highly reliable in operation.

Briefly, and in accordance with the foregoing objects, a compression tool according to the invention comprises a tool head, die means mounted in said tool head for compressingly, surroundingly engaging a generally tubular workpiece, said die means defining a minimum opening and a maximum opening therein for accommodating workpieces over a corresponding range of sizes, fluid operated drive means for driving said movable die means to compress said workpiece and fluid pressure control means for controllably varying the maximum pressure of the fluid supplied to said fluid operated drive means in a predetermined fashion in accordance with the size of a workpiece to be compressed.

BRIEF DESCRIPTION OF THE DRAWINGS

Other objects, features and advantages of the invention will become more readily apparent upon reading the following detailed description of the illustrated embodiment together with reference to the accompanying drawings wherein.

DETAILED DESCRIPTION OF THE ILLUSTRATED EMBODIMENT

Figure 1:
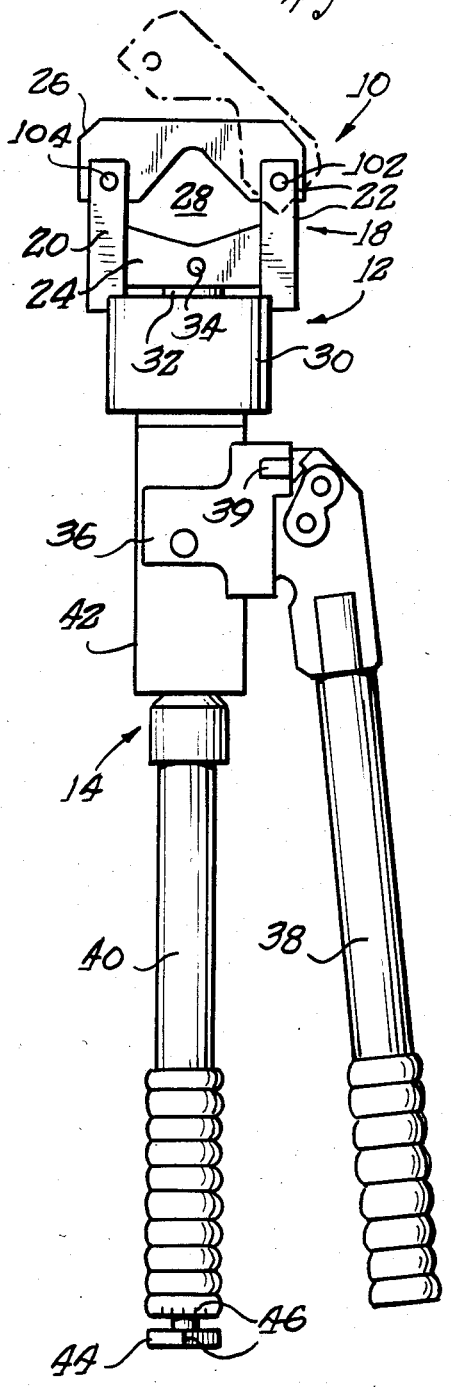
FIG. 1 is an elevational view of a compression tool in accordance with the present invention.

Referring now to the drawings and initially to FIG. 1, a compression tool in accordance with the present invention is designated generally by the reference numeral 10. Broadly speaking, this compression tool 10 includes a tool head 12, a manually controlled tool actuating portion 14.

The tool head 12 comprises a die assembly 18 and a drive assembly 30 for actuating the die assembly 18. In the illustrated embodiment, the die assembly 18 includes a pair of elongate guide members 20, 22 which slidably mount a lower die member 24 therebetween. An upper die member 26 is mounted to respective top ends of the elongate guide member 20, 22. Between the lower die 24 and the upper die 26 a workpiece-receiving through opening 28 is defined. As will be more fully explained later, and in accordance with a feature of the invention, these dies 24 and 26 and the guide members 20, 22 are arranged for compressing or crimping terminals or connectors into engagement with electrical cables or conductors. Moreover, the compression tool 10 readily accommodates such connectors or terminals and associated electrical cables over a relatively broad range of sizes. This novel arrangement avoids the necessity of providing a plurality of interchangeable, removable sets of dies for accommodating such a range of sizes of conductors and connectors or terminals.

The drive assembly 30 is mounted intermediate the die assembly 18 and the manual actuating portion 14. This drive assembly 30 is coupled with the lower die 24 for driving the lower die upwardly, sliding along the guides 20, 22, so as to compress a workpiece between the lower die 24 and upper die 26. In the illustrated embodiment, this drive assembly 30 comprises a hydraulic piston-and-cylinder or ram arrangement, the piston 32 thereof being coupled with the lower die member 24 by suitable means such as a pin 34 extending therethrough.

Hydraulic fluid under pressure is delivered to this hydraulic ram assembly 30 by means of a pump 36 mounted within an upper portion of the manual actuating portion 14. In this regard, the actuating portion 14 includes a first handle 38 which is pivotally mounted at a pivot point 39 to a second handle 40. This handle 38 is also operatively coupled for energizing or actuating the pump 36. Accordingly, pivotal mounting of the handle 38 with respect to the handle 40 defines a lever for actuating the pump 36. Hence, the pump 36 is located upon the handle 40 but is actuated by the pivotal movement of the handle 38.

The handle 40 also mounts a variable pressure control apparatus 42 (not shown in detail in FIG. 1) for controlling the maximum pressure of the fluid delivered to the hydraulic ram assembly 30 by the pump 36 in response to pivotal movement of the handle 38. This pressure control apparatus 42 is adjustable in response to manual rotation of an adjustment knob 44 rotatably carried in the handle 40. In the illustrated embodiment, this adjustment member or knob 44 is carried at the bottom of the handle 40. Preferably, indicia 46 are provided on the knob 44 and on the periphery of the handle 40 immediately adjacent thereto for selecting the maximum fluid pressure. In operation, the maximum pressure delivered to the hydraulic ram assembly 30 is therefore controlled in accordance with the setting of the knob 44. In this regard, the fluid pressure to be applied to the hydraulic ram assembly will generally increase as the pump handle 38 is actuated. However, a maximum pressure is preselected for each size of workpiece to be compressed by the die assembly 12. Hence, the range of relative movement of the die members 24 and 26, and the range of maximum pressure selectable by the knob 44 and pressure control apparatus 42 together define a range of sizes of workpieces which may be accommodated for compression by the tool 10.

Figure 2:
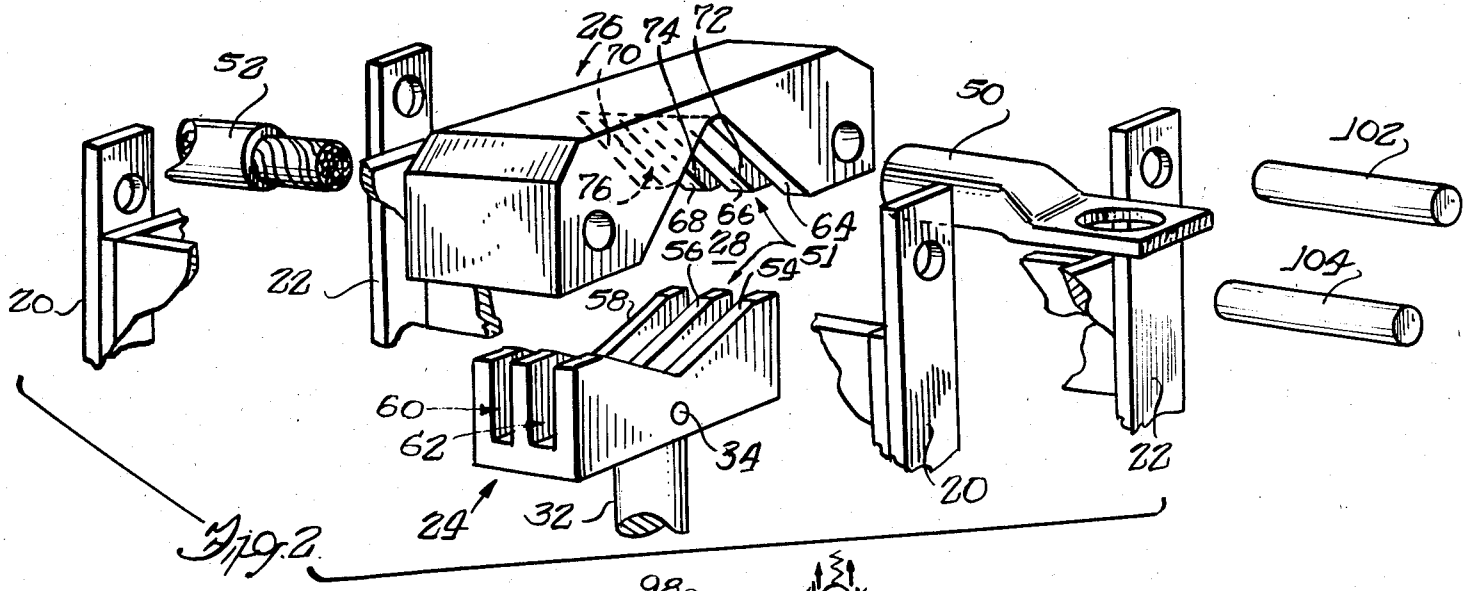
FIG. 2 is an enlarged perspective view of die portions of the tool of FIG. 1.

Referring now to FIG. 2, the die assembly 18 including the guide members 20, 22, the lower die 24 and the upper die 26 will now be described in greater detail. Also illustrated in FIG. 2 is a typical electrical connector or terminal member 50 and an electrical conductor or wire 52 which is to be compressingly engaged or crimped within the tubular conductor or terminal 12 by the action of the tool 10 of the invention.

In accordance with a feature of the invention, a composite die is defined by the lower die member 24 and the upper die member 26, which comprises a plurality of intermeshing die surfaces, indicated generally by the reference numeral 51. These intermeshing die surfaces 51 define a relatively broad range of compression, thereby accommodating a corresponding range of sizes of connectors or terminals such as the terminal 50 for compression. In the illustrated embodiment, the intermeshing die surfaces 51 are defined by a plurality of die surfaces and intervening recesses on each of the lower die member and upper die member 26.

In this latter regard, in the illustrated embodiment, the lower die member 24 defines three substantially similar and parallel die surfaces 54, 56 and 58 which are separated by a pair of recesses 60, 62. Similarly, the upper die member 26 defines four die surfaces 64, 66, 68 and 70 which are substantially similar and parallel and are separated by three recesses 72, 74 and 76. The guides 22 and 20 hold the lower die member 24 and upper die member 26 in alignment such that the die surfaces 54, 56 and 58 of the lower die member 24 are in alignment with, and as the die member 24 advances, intermesh or interfit with the recesses 72, 74 and 76 of the upper die member 26. Correspondingly, the die surfaces 66 and 68 of the upper die member 26 are aligned with and, as the die member 24 advances, interfit with the recesses 60 and 62 of the lower die member 24. The remaining die surfaces 64 and 70 of the upper die member 26 align with and slidably engage over the outer sides of the die surfaces 54 and 58 of the lower die member 24.

Figure 3:
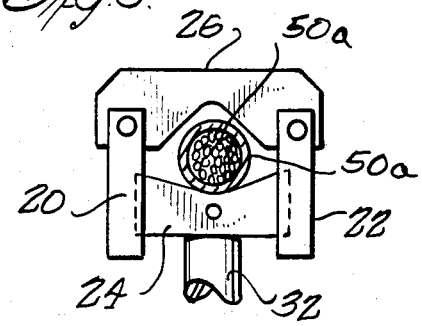
FIG. 3 is a reduced view illustrating one aspect of operation of the dies of FIG. 2.
Figure 4:
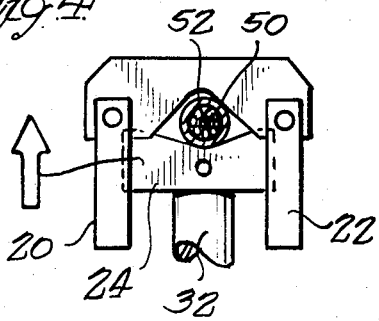
FIG. 4 is another reduced view illustrating another aspect of operation of the dies of FIG. 2.
Figure 5:
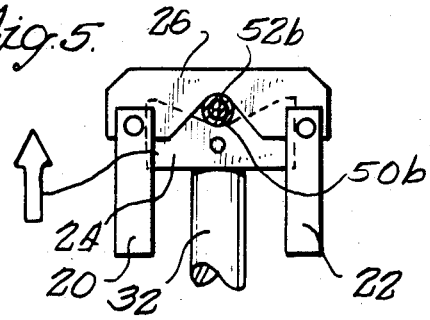
FIG. 5 is yet another reduced view illustrating a further aspect of the operation of the dies of FIG. 2.

In operation, and referring to FIG. 3, FIG. 4 and FIG. 5, the foregoing intermeshing of the respective die members 24 and 26 as the lower, movable die member 24 is advanced by the ram 30, is illustrated. It will be seen from an inspection of these three illustrations that the die assembly 12 as thus far described defines a range of sizes of the through opening 28 from a fully opened position illustrated in FIG. 3 to a fully closed position illustrated in FIG. 5. In this latter, fully closed position, the respective die surfaces and receiving recesses described above are fully interengaged and bottomed out with respect to each other. Hence, a corresponding range of sizes of workpieces such as the electrical connector or terminal 50 and associated cable 52 may be accommodated for compression by the die assembly of the invention as thus far described.

Figure 6:
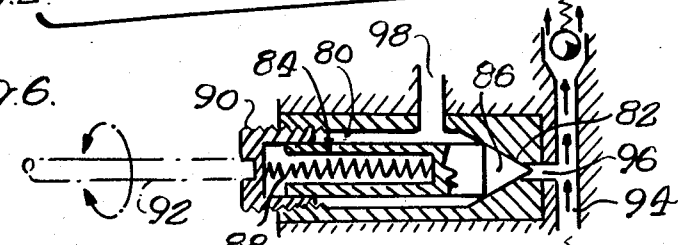
FIG. 6 is an enlarged sectional view, somewhat diagrammatic in form, of a pressure control portion of the tool of FIG. 1.
Figure 7:
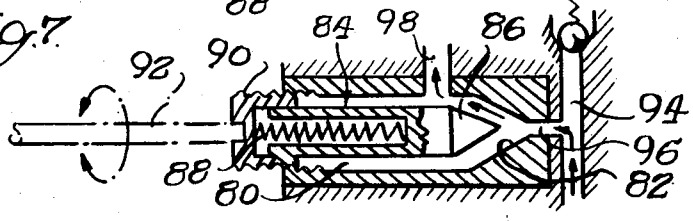
FIG. 7 is a view similar to FIG. 6 and illustrating another aspect of the operation of the pressure control portion.

Reference is next invited to FIG. 6 and FIG. 7, wherein further details of the variable pressure control apparatus 42 are shown. Preferably, this pressure control apparatus 42 comprises an adjustable relief or bypass valve. In the illustrated embodiment, this pressure relief or bypass valve comprises a generally cylindrical valve chamber 80 which terminates in a conical section 82 defining a valve seat. A correspondingly cylindrical valve member 84 terminates in a generally conical end 86 for seating on the valve seat 82. The valve member 84 and in particular, the end 86 thereof is normally urged into seating engagement with the valve seat 82 by a compression spring 88 which is carried internally of the cylindrical valve portion 84. The opposite end of the spring 88 abuts an adjustable screw or stop member 90 which is threadably movable with respect to the valve chamber 80.

In operation, as the threaded stop member 90 is advanced with respect to the valve chamber 80, the compressive force applied to the spring 88 increases, tending to urge the valve portion 86 into seating engagement with the valve seat 82 with increasing force. Conversely, as the threaded stop member 90 is threadably retracted with respect to the valve chamber 80, a lesser such force is supplied by the spring 88. The stop member 90 is rotated for either threadable advancement or retraction by an elongate rod 92 which extends axially through the handle 40 (see FIG. 1) and is coupled at its opposite end to the adjustment knob 44.

The valve 42 is coupled in hydraulic circuit for varying the maximum pressure applied to the hydraulic ram assembly 30 by the pump 36. In this regard, a first hydraulic fluid line 94 carries hydraulic fluid from the pump 36 to the hydraulic ram assembly 30. The valve seat 82 communicates with this first fluid passageway 94 by way of a through bore or passageway 96. This bore or passageway 96 is normally held in a closed condition by the seating of the conical valve 86 upon the conical valve seat 82. However, when the fluid pressure in the passageway 94 applies a force to the end 86 of the valve member 84 at the passageway 96 which exceeds the force applied by the spring 88 to hold the valve 86 seated, the valve body 84 will be forced back, compressing the spring 88 and permitting fluid from the passageway 94 to enter into and through the passageway 96 to the interior of the valve body 80. In this regard a second, return bore or passageway 98 is provided in the valve body and is coupled for returning fluid to a suitable fluid reservoir (not shown).

A fluid return line (not shown) from the ram 30 is also preferably provided, including a suitable valve (not shown) to permit the ram to return the die 24 to its fully open position following compression. The conduit 94 preferably includes a suitable ball check element 100 for preventing back flow. The relative pressure in the line 94 at which the valve 84 unseats may be referred to as a relief pressure or by-pass pressure of the valve. This relief or by-pass pressure is adjusted to correspond to a predetermined or desired maximum pressure to be applied to workpieces or connectors of given sizes. In this regard, the indicia 46 on the handle 40 and/or adjustment knob 44 preferably indicate the desired positions of the adjustment knob 44 for a plurality of sizes of connectors or terminals compressable by the tool 10 of the invention.

In operation, when a connector or a terminal such as the terminal 50 is to be coupled with a cable such as the cable 50 by compression in the tool of the invention, the adjustment 44 is first set to an indicia 46 corresponding to the size of the terminal or connector 50. Thereupon, the handle 38 may be manually, pivotally actuated toward the handle 40 to energize the pump 36 and hence hydraulic ram assembly 30, driving the movable or slidable lower die member 34 upwards towards the relatively fixed or stationary upper die member 26. When the selected maximum or relief pressure has been reached, pressure will be relieved by the valve arrangement 42 of FIG. 6 and FIG. 7, permitting the lower die 34 to return to its open condition, whereupon the compressed and joined connector or terminal 50 and wire or cable 52 may be removed from the die opening 28.

In accordance with one practical and preferred form of the invention and referring again to FIG. 2, the upper die member 26 is preferably coupled with the top or upper portion of the respective guides 20, 22 by a pair of suitable pins 102, 104. Preferably, one of these pins 102, 104 is removable, whereby the upper die member 26 is hingedly movable with respect to one of the two guide members 20, 22. Consequently, a connector for joining a pair of wires in serial fashion may be accommodated by the tool 10 of the invention.

In this illustrated embodiment, the die surfaces 54, 56 and 58 of the lower die member are all generally V-shaped, whereby their outermost leading edges intermesh with like inwardly-formed portions of the recesses in the upper die member 26. Similarly, the die surfaces 64, 66, 68 and 70 of the upper die member 26 are also generally V-shaped to intermesh with similar recesses of the lower die member 24. Preferably, the leading edges of the respective die surfaces of both upper die member 26 and the lower die member 24 are generally flat or horizontal, that is, generally perpendicular to the direction of movement of the die 24, for defining a firm and definite seat with the respective and similar receiving recesses and thus positively defining the maximum extent of compression of the die assembly 12.

Figure 8:
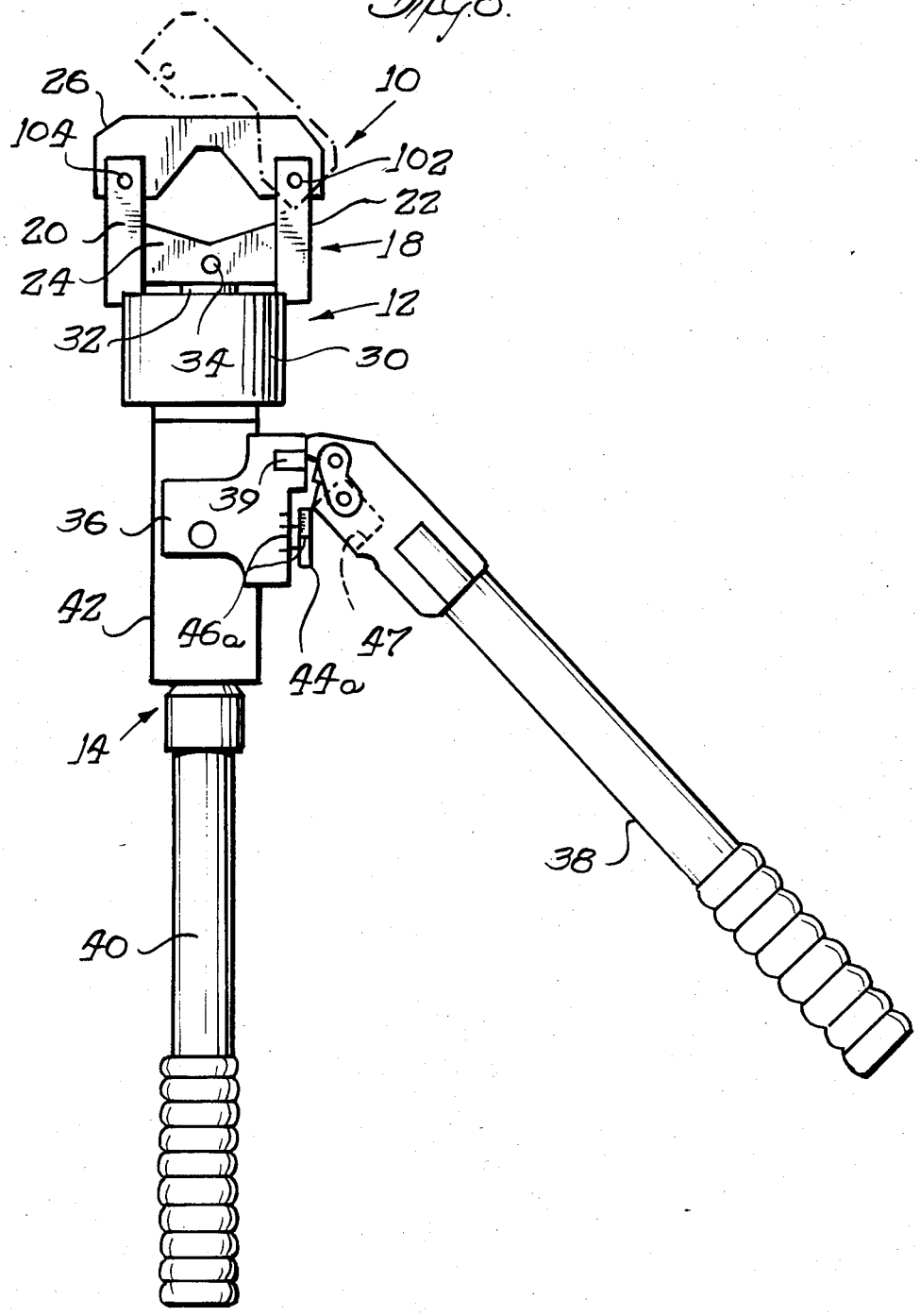
FIG. 8 is a view similar to FIG. 1 and illustrating an alternate embodiment of the tool of the invention.

Referring now to FIG. 8, an alternate embodiment of the compression tool of the invention is illustrated.

The tool of FIG. 8 is similar to the tool of FIG. 1, and hence, like reference numerals are utilized in FIG. 8 to indicate like elements. Departing from the embodiment of FIG. 1, an adjustment member or knob **44*a* is mounted projecting or protruding from a side surface of the pump 36. Suitable indicia for indicating the relative adjustment or position of knob 44*a* are provided respectively upon the knob 44*a* and on an adjacent surface of the pump 36. It will be seen that the second or pivotally mounted handle 38 is illustrated in FIG. 8 in its extended or open position with respect to handle 40. As described previously, the pivotally mounted handle 38 is movable between the position indicated in FIG. 8 and the position indicated in FIG. 1 for actuating the pump 36**.

In order to accommodate the protruding adjustment member or knob **44*a* when the handle 38 is in the position illustrated in FIG. 1, a cut-out or recess portion 47 is provided in a side surface of handle 38 facing the protruding knob 44*a*. Hence, the operator may readily adjust knob 44*a* by moving handle 38 to the position illustrated in FIG. 8, during operation of the tool in the field, to adjust or change the pressure applied to the workpiece by the dies as desired. In this regard, knob 44*a* will be understood to be engaged with the rotatable stop member 90 either directly or by suitable means such as a relative short interconnecting rod similar to rod 92. However, since the knob 44*a* is located projecting from the body of pump 36, rather than at the free outer end of handle 40 as in the embodiment of FIG. 1, the elongate rod 92 extending axially through handle 40 is not utilized or required in the embodiment of FIG. 8**.

It will be seen from the foregoing that the invention includes an advantageously outwardly protruding or projecting knob, 44 or **44*a*, located for grasping by the operator to adjust the pressure applied by the tool in the field. As described hereinabove, this pressure control member or adjustment knob 44 or 44*a* is mounted to project from a selected part of the manual actuating portion 14 of the tool 10. Preferably, mounting means are coupled with the fixed handle 40 to mount the knob to protrude therefrom in such a way as not to interfere with the pivotal movement of handle 38 with respect to handle 40. Hence, in the illustrated embodiments, the knob 44 or 44*a* is mounted either extending from the free outer end of handle 40, or alternatively, extending outwardly from the pump 36 with a complementary recess 47 being provided in handle 38** to avoid intereference therewith.

While the invention has been illustrated and described hereinabove with reference to a preferred embodiment, the invention is not limited thereto. Those skilled in the art may devise various alternatives, changes and modifications upon reading the foregoing descriptions. Accordingly, the invention includes such alternatives, changes and modifications insofar as they fall within the spirit and scope of the appended claims.

The invention is claimed as follows:

1. A compression tool comprising: a tool head, a die set including fixed and movable die means mounted in said tool head for compressingly, surroundingly engaging a generally tubular workpiece, said die means being continuously variably positionable for defining an opening of variable size between a predetermined minimum opening and predetermined maximum opening therefor for selectively compressing relatively large to relatively small workpieces over a corresponding range of sizes by the same said die set, fluid operated drive means for driving said movable die means toward said predetermined minimum opening to compress a preselected size of workpiece; and fluid pressure control means manually readily accessible in view to an operator in on-the-job field use for preselecting and presetting the maximum pressure of the fluid supplied to said fluid operated drive means for the preselected size of workpiece to be compressed and thereby controlling the maximum force applied by the drive means to the die means and the maximum compressive force applied by the die means to the selected size of workpiece within the range of sizes which may be accommodated by the same said die set; wherein said fluid pressure control means comprises a manually adjustable member protruding from the tool and accessible to an operator and indicia means for indicating a plurality of positions of said manually adjustable member, each position corresponding to a presettable maximum pressure for at least one of said plurality of sizes of workpieces to be compressed; wherein said fluid operated drive means includes a pair of handles defining a lever, wherein said manually adjustable member comprises a knob protruding from a free end portion of one of said handles, and wherein said indicia means are located on the knob and on a periphery of the handle adjacent thereto.

2. A compression tool according to claim 1 wherein each of said fixed die means and said movable die means comprises a plurality of parallel die members which are fixed relative to each other and define a plurality of parallel working die surfaces spaced apart by a plurality of recesses, each die member having a pair of flat parallel sides and multi-faceted working die surfaces at an end thereof facing the other of said fixed and movable die means, said multi-faceted working surfaces being transverse to and extending intermediate the flat sides of said die member; the plurality of die members of each of said fixed and movable die means being respectively aligned such that corresponding surface portions of each of said multi-faceted working die surfaces are in substantially coplanar alignment; said fixed and movable die means being aligned with each other such that the respective die members thereof intermesh with each other and such that the multi-faceted working die surfaces of each are aligned with the recesses of the other such that the respective working die surfaces at least partially overlap each other during movement from the predetermined minimum opening in the predetermined maximum opening.

3. A compression tool according to claim 1 wherein said fluid pressure control means further includes a relief valve mounted interiorly of the tool and inaccessible to an operator, said relief valve being movable to a plurality of positions, each position corresponding to a given relief pressure; and wherein said manually adjustable member is operatively coupled with said relief valve to achieve movement of the relief valve to a desired one of said plurality of positions, said indicia indicating each of said plurality of positions of said relief valve.

4. A compression tool for compressing a generally tubular workpiece comprising: a tool head, a die set including fixed and movable die means mounted in said tool head, said movable die means intermeshing with said fixed die means for surroundingly engaging and compressing said tubular workpiece, said movable die means being continuously variably positionable relative to said fixed die means for defining an opening of variable size between a predetermined minimum opening and a predetermined maximum opening for selectively compressing relatively large and relatively small workpieces over a corresponding range of sizes by the same said die set, fluid operated drive means for driving said movable die means towards said predetermined minimum opening to compress a preselected size of workpiece; and fluid pressure control means including a manually adjustable member readily accessible and in view to an operator in on-the-job field use for preselecting and presetting the maximum pressure of the fluid supply to said fluid operated drive means for the preselected size of workpiece to be compressed and thereby controlling the force applied by the drive means to the die means and the compressive force applied by the die means to the selected size of workpiece within the range of sizes which may be accommodated by the same said die set; wherein said manually adjustable member protrudes from the tool to be accessible to an operator, and wherein said fluid operated drive means includes a fixed handle and a movable handle movably mounted to said fixed handle to define a lever, and further including mounting means coupled with said fixed handle for mounting said manually adjustable member to protrude therefrom substantially without interferring with the pivotal motion of said movable handle relative to said fixed handle; and wherein said mounting means comprises a rotatable shaft protruding from a free outer end portion of said fixed handle and said adjustable member comprises a knob coupled with said shaft.

5. A compression tool according to claim 4 wherein each of said fixed die means and said movable die means comprises a plurality of parallel die members which are fixed relative to each other and define a plurality of parallel working die surfaces spaced apart by a plurality of recesses, each die member having a pair of flat parallel sides and multi-faceted working die surfaces at an end thereof facing the other of said fixed and movable die means, said multi-faceted working surfaces being transverse to and extending intermediate the flat sides of said die member; the plurality of die members of each of said fixed and movable die means being respectively aligned such that corresponding surface portions of each of said multi-faceted working die surfaces are in a substantially coplanar alignment; said fixed and movable die means being aligned with each other such that the respective die members thereof intermesh with each other and such that the multi-faceted working die surfaces of each are aligned with the recesses of the other such that the respective working die surfaces at least partially overlap each other during movement from the predetermined minimum opening to the predetermined maximum opening.

6. A compression tool ccording to claim 4 wherein said fluid pressure control means further includes a relief valve mounted interiorly of the tool and inaccessible to an operator, said relief valve being movable to a plurality of positions, each position corresponding to a given relief pressure; and wherein said manually adjustable member is operatively coupled with said relief valve to achieve movement of the relief valve to a desired one of said plurality of positions, said indicia indicating each of said plurality of positions of said relief valve.

7. A compression tool according to claim 4 wherein each of said plurality of working die surfaces of said fixed die means and of said movable die means are substantially concave for together surroundingly compressingly engaging said workpiece.

8. A compression tool according to claim 4 wherein said intermeshing working die surfaces collectively define an aggregate working die surface which is substantially polygonal in cross-section.

9. A compression tool according to claim 4 wherein said fluid operated drive means comprises hydraulic piston means coupled for inwardly compressingly moving said die means and pump means coupled in hydraulic circuit for energizing said piston means.

10. A compression tool according to claim 9 wherein said tool further includes manually operated handle means coupled with said tool head and operatively coupled for actuating said pump means.

11. A compression tool according to claim 9 wherein said pressure control means comprises an adjustable pressure relief bypass valve coupled in hydraulic circuit with said pump means.

12. A compression tool according to claim 11 wherein said pressure relief bypass valve comprises a valve seat and a valve member, means for urging said valve member to a seated position against said valve seat and means for varying the force applied to said valve member by said urging means and thereby varying the relief pressure of said pressure relief bypass valve.

13. A compression tool according to claim 12 wherein said bypass valve further comprises a cylindrical valve chamber including a return opening in a side portion thereof, said valve seat defining one end of said valve chamber and having a port in hydraulic circuit with said pump means, said valve body comprising an end portion for complementary engagement with said valve seat and a cylindrical body extending to an opposite end of said chamber; said urging means comprising elongate compression spring means carried within said cylindrical valve body; said force varying means comprising stop means threadably engaged for axial movement with said opposite end of said valve chamber and surroundingly receiving an end of said tubular member opposite said first end portion for abutment with said compression spring means.

14. A compression tool according to claim 10 wherein said handle means comprises a first handle pivotally mounted to a second handle to define a lever for actuating said pump means.

15. A compression tool according to claim 14 wherein said pump means is carried in said second handle, wherein said drive means is mounted intermediate said second handle and said tool head and wherein said fluid pressure control means is carried in said second handle.

16. Apparatus according to claim 4 and further including means defining a hinge-like connection between said fixed die means and said tool head, whereby said fixed die means may be pivoted away from said tool head to facilitate ingress and egress of said workpiece.

* * * * *